US007287381B1

(12) United States Patent
Pierson et al.

(10) Patent No.: US 7,287,381 B1
(45) Date of Patent: Oct. 30, 2007

(54) POWER RECOVERY AND ENERGY CONVERSION SYSTEMS AND METHODS OF USING SAME

(75) Inventors: Tom L. Pierson, Sugar Land, TX (US); John David Penton, Pasadena, TX (US)

(73) Assignee: Modular Energy Solutions, Ltd., Houston, TX (US)

( * ) Notice: Subject to any disclaimer, the term of this patent is extended or adjusted under 35 U.S.C. 154(b) by 175 days.

(21) Appl. No.: 11/243,654

(22) Filed: Oct. 5, 2005

(51) Int. Cl.
*F01K 25/10* (2006.01)

(52) U.S. Cl. ..... 60/651; 60/653; 60/671

(58) Field of Classification Search ..... 60/651, 60/653, 670, 671
See application file for complete search history.

(56) References Cited

U.S. PATENT DOCUMENTS

| | | | |
|---|---|---|---|
| 1,632,575 A | 6/1927 | Abendroth | |
| 4,557,112 A | 12/1985 | Smith | 60/651 |
| 4,586,340 A | 5/1986 | Kalina | 60/673 |
| 4,604,867 A | 8/1986 | Kalina | 60/653 |
| 4,732,005 A | 3/1988 | Kalina | 60/673 |
| 4,899,545 A | 2/1990 | Kalina | 60/673 |
| 5,029,444 A | 7/1991 | Kalina | 60/673 |
| 5,095,708 A | 3/1992 | Kalina | 60/673 |
| 5,440,882 A | 8/1995 | Kalina | 60/641.2 |
| 5,557,936 A | 9/1996 | Drnevich | 60/694 |
| 5,572,871 A | 11/1996 | Kalina | 60/649 |
| 5,754,613 A | 5/1998 | Hashiguchi et al. | 376/378 |
| 5,953,918 A | 9/1999 | Kalina et al. | 60/653 |
| 6,058,695 A | 5/2000 | Ranasinghe et al. | 60/39.182 |
| 6,195,997 B1 | 3/2001 | Lewis et al. | 60/648 |
| 6,269,644 B1 | 8/2001 | Erickson et al. | 60/649 |

(Continued)

FOREIGN PATENT DOCUMENTS

| | | | |
|---|---|---|---|
| JP | 53-132638 | 11/1978 | 60/671 |

(Continued)

*Primary Examiner*—Hoang Nguyen
(74) *Attorney, Agent, or Firm*—Williams, Morgan & Amerson, P.C.

(57) ABSTRACT

In various illustrative examples, the system may include heat recovery heat exchangers, one or more turbines or expanders, a desuperheater heat exchanger, a condenser heat exchanger, a separator, an accumulator, and a liquid circulating pump, etc. In one example, a bypass desuperheater control valve may be employed. The system comprises a first heat exchanger adapted to receive a heating stream from a heat source after passing through a second heat exchanger and a second portion of a working fluid, wherein, the second portion of working fluid is converted to a hot liquid via heat transfer. An economizer heat exchanger that is adapted to receive a first portion of the working fluid and the hot discharge vapor from at least one turbine may also be provided. The first and second portions of the working fluid are recombined in a first flow mixer after passing through the economizer heat exchanger and first heat exchanger, respectively. A second heat exchanger is provided that receives the working fluid from the first flow mixer and a hot heating stream from a heat source and convert the working fluid to a hot vapor. The hot vapor from the second heat exchanger is supplied to at least one turbine after passing through a separator designed to insure no liquid enters the said at least one turbine or expander. The hot, high pressure vapor is expanded in the turbine to produce mechanical power on a shaft and is discharged as a hot, low pressure vapor.

36 Claims, 3 Drawing Sheets

U.S. PATENT DOCUMENTS

| | | | | |
|---|---|---|---|---|
| 6,318,065 | B1 | 11/2001 | Pierson | 60/39.02 |
| 6,321,552 | B1 | 11/2001 | Frederiksen | 62/238.3 |
| 6,347,520 | B1 | 2/2002 | Ranasinghe et al. | 60/649 |
| 6,470,686 | B2 | 10/2002 | Pierson | 60/772 |
| 6,571,548 | B1 | 6/2003 | Bronicki et al. | 60/39.02 |
| 6,581,384 | B1 | 6/2003 | Benson | 60/653 |
| 6,615,585 | B2 | 9/2003 | Tsuji | 60/728 |
| 6,857,268 | B2 * | 2/2005 | Stinger et al. | 60/651 |
| 6,964,168 | B1 * | 11/2005 | Pierson et al. | 60/670 |
| 7,095,665 | B2 * | 8/2006 | Song | 365/205 |
| 2002/0017095 | A1 | 2/2002 | Pierson | 60/39.02 |
| 2002/0162330 | A1 | 11/2002 | Shimizu et al. | 60/651 |
| 2004/0011038 | A1 * | 1/2004 | Stinger et al. | 60/651 |

FOREIGN PATENT DOCUMENTS

| | | | |
|---|---|---|---|
| JP | 59-068505 | 4/1984 | 60/671 |

* cited by examiner

POWER RECOVERY AND ENERGY CONVERSION SYSTEMS AND METHODS OF USING SAME

BACKGROUND OF THE INVENTION

1. Field of the Invention

The present invention generally relates to heat recovery for the purpose of electrical or mechanical power generation. Specifically, the present invention is directed to various systems and methods for the conversion of heat of any quality into mechanical or electrical power.

2. Description of the Related Art

In general, there is a constant drive to increase the operating efficiency of heat and power recovery systems. By increasing the efficiency of such systems, capital costs may be reduced, more power may be generated and there may be a reduction of possible adverse impacts on the environment, e.g., a reduction in the amount of waste heat that must ultimately be absorbed by the environment. In other industrial processes, an excess amount of heat may be generated as a byproduct of the process. In many cases, such waste heat is normally absorbed by the environment through the use of waste heat rejection devices such as cooling towers.

There are several systems employed in various industries to produce useful work from a heat source. Such systems may including the following:

Heat Recovery Steam Generators (HRSG)—Typically, waste heat from gas turbines or other, similar, high quality heat sources is recovered using steam at multiple temperatures and pressures. Multiple operating levels are required because the temperature-enthalpy profile is not linear. That is, such prior art systems involve isothermal (constant temperature) boiling as the working fluid, i.e. water, is converted from a liquid to a vapor state. Various embodiments of the present invention eliminate the need for multiple levels and simplify the process while having the capability to recover more heat and to economically recover heat from a much lower quality heat source.

Rankine Cycle—The classic Rankine cycle is utilized in conjunction with HRSGs to produce power. This process is complex and requires either multiple steam turbines or a multistage steam turbine, feed water heaters, steam drums, pumps, etc. The methods and systems of the present invention are significantly less complex while being more effective than systems employing the Rankine cycle.

Organic Rankine Cycle—Similar to the classic Rankine cycle, an Organic Rankine cycle utilizes a low temperature working fluid such as isoButane or isoPentane in place of steam in the classic cycle. The system remains complex and is highly inefficient at low operating temperature differences.

Kalina Cycle—Dr. Kalina's cycle is a next generation enhancement to the Rankine cycle utilizing a binary fluid mixture, typically water and ammonia. Water and ammonia are utilized at different concentrations in various portions of the process to extend the temperature range potential of the cycle and to allow higher efficiencies than are possible in the Rankine cycle. The methods and systems of the present invention simplify the process while having the capability to recover more heat and to recover heat from a low quality heat source.

The system depicted in FIG. 5 is an example of a prior art system for heat recovery. The system comprises two heat recovery heat exchangers 120 and 121, two turbines (expanders) 122 and 124, and a reheater heat exchanger 123. The prior art system may or may not have a separate gas cooler 125 and condenser 126. The subcritical working fluid

102 enter the first heat recovery heat exchanger 120 at approximately the condensing temperature from a condenser 126. The liquid 102 is heated via heat transfer with the discharged hot fluid 114 from the reheater heat exchanger 123 and is discharged as either a wet or dry vapor 103 after boiling either partially or completely in heat recovery heat exchanger 120. The working fluid 103 is further heated in the second heat recovery heat exchanger 121 to a dry vapor 104 via heat transfer with the hot heat source 112 and is supplied to the inlet of the first turbine 122. In at least some cases, the vapor 104 is at a temperature near or slightly above its critical temperature but well below its critical pressure. The hot vapor 104 is expanded in turbine 122 and exits as a hot vapor 105. The hot vapor 105 is introduced into a reheater heat exchanger 123 where is heated (reheated) by the hot heating fluid 113 discharged from the second heat recovery heat exchanger 121 via heat transfer. The reheated working fluid 106 is then supplied to the inlet of the second turbine 124 wherein it is expanded and discharged as a hot, typically dry and highly superheated, vapor 107. The discharged vapor 107 from the second turbine 124 may or may not be cooled in a gas cooler 125 before being condensed in a condenser heat exchanger 126.

In the prior art system of FIG. 5, the subcritical working fluid 102 enter the first heat recovery heat exchanger 120 at approximately the condensing temperature from a condenser 126. Said liquid 102 is heated via heat transfer with the discharged hot fluid 114 from the reheater heat exchanger 123 and is discharged as either a wet or dry vapor 103 after boiling either partially or completely in heat recovery heat exchanger 120. Said working fluid 103 is further heated in the second heat recovery heat exchanger 121 to a dry vapor 104 via heat transfer with the hot heat source 112 and is supplied to the inlet of the first turbine 122. In the most preferred embodiment the vapor 104 is at a temperature near or slightly above its critical temperature but well below its critical pressure. The hot vapor 104 is expanded in turbine 122 and exits as a hot vapor 105. Such hot vapor 105 is introduced into a reheater heat exchanger 123 where is heated (reheated) by the hot heating fluid 113 discharged from the second heat recovery heat exchanger 121 via heat transfer. The reheated working fluid 106 is then supplied to the inlet of the second turbine 124 wherein it is expanded and discharged as a hot, typically dry and highly superheated, vapor 107. The discharged vapor 107 from the second turbine 124 may or may not be cooled in a gas cooler 125 before being condensed in a condenser heat exchanger 126.

The four largest weaknesses of the prior art system are a) the vapor 107 discharged from the second turbine 124 is significantly superheated and thereby the system of FIG. 5 fails to recover a portion of the valuable heat, b) the system utilizes a subcritical working fluid which limits the efficiency of the heat recovery in the heat recovery heat exchangers 120 and 121 due to the non-linearity of the temperature-enthalpy profile in said exchangers, c) the system generates unnecessary entropy further reducing its output in accordance with the Second Law of Thermodynamics, and d) the complexity of the system having multiple turbines and multiple heat recovery heat exchangers is reflected in an increased cost of the system for a given capacity. recovery heat exchanger(s) are usually the largest costs in a system of the type.

The following patents may be descriptive of various aspects of the prior art: U.S. Pat. No., 5,557,936 to Drnevich; U.S. Pat. No., 5,029,444 to Kalina; U.S. Pat. No. 5,440,882 to Kalina; U.S. Pat. No. 5,095,708 to Kalina; U.S.

Pat. No. 5,572,871 to Kalina; Japanese Patent S53-132638A to Nakahara and Fujiwara; U.S. Pat. No. 6,195,997 to Lewis; U.S. Pat. No. 4,577,112 to Smith; U.S. Pat. No. 6,857,268 to Stinger and Mian; each of which are hereby incorporated by reference.

In general, what is desired are systems and methods for improving the efficiencies of various heat conversion and power generation systems and systems and methods for utilizing waste heat sources to improve operating efficiencies of various power and industrial systems. The present invention is directed to various systems and methods that may solve, or at least reduce, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is generally directed to various systems and methods for producing mechanical power from a heat source. In various illustrative examples, the devices employed in practicing the present invention may include at least two heat recovery heat exchangers, at least one turbine or an expander, a desuperheater heat exchanger, an economizer heat exchanger, a condenser heat exchanger, an accumulator, a separator, and a liquid circulating pump, etc.

In one illustrative embodiment, the system comprises a first heat exchanger adapted to receive a heating stream from a heat source after passing through a second heat exchanger and a second portion of a working fluid, wherein, when the second portion of the working fluid is passed through the first heat exchanger, the second portion of working fluid is converted to a hot liquid via heat transfer from the heat contained in the heating stream from the heat source after passing through a second heat exchanger. The system is further comprised of an economizer heat exchanger adapted to receive a first portion of the working fluid and the hot discharge vapor from at least one turbine. The first and second portions of the working fluid are recombined in a first flow mixer after passing through the economizer heat exchanger and first heat exchanger, respectively. The system is further comprised of a second heat exchanger adapted to receive the working fluid from the first flow mixer and a hot heating stream from a heat source and convert the working fluid to a hot vapor. The hot vapor from the second heat exchanger is supplied to at least one turbine or expander after passing through a separator designed to insure no liquid enters said at least one turbine. The hot, high pressure vapor is expanded in the turbine to produce mechanical power on a shaft and is discharged as a hot, low pressure vapor. The hot vapor is then routed back to the economizer heat exchanger and then to a second flow mixer (which may function as a desuperheater in some cases) where the hot vapor is mixed with the liquid discharged from the separator. The system further comprises a condenser heat exchanger that is adapted to receive the exhaust vapor from the turbine after passing through the economizer heat exchanger and mixing with the liquid from the separator and a cooling fluid circulated by a cooling fluid pump. The system is further comprised of an accumulator vessel to receive the condensed liquid from the condenser and meter said condensate to a liquid working fluid circulating pump that is adapted to circulate the working fluid to a flow divider. The system is finally comprised of a flow divider that is adapted to split the working fluid into at least two portions, at least one that is supplied to an economizer heat exchanger and at least one that is supplied to a first heat exchanger.

In another illustrative embodiment, the system comprises a first heat exchanger adapted to receive a heating stream from a heat source after passing through a second heat exchanger and a second portion of a working fluid, wherein, the second portion of the working fluid is passed through the first heat exchanger, the second portion of working fluid is converted to a hot liquid via heat transfer from the heat contained in the heating stream from the heat source after passing through a second heat exchanger. The system is further comprised of an economizer heat exchanger adapted to receive a first portion of the working fluid and the hot discharge vapor from at least one turbine. The system is further comprised of a second flow mixer or desuperheater adapted to receive a third portion of the working fluid via a fluid bypass control valve. The first and second portions of the working fluid are recombined in a first flow mixer after passing through the economizer heat exchanger and first heat exchanger, respectively. The system is further comprised of a second heat exchanger adapted to receive the working fluid from the first flow mixer and a hot heating stream from a heat source and heat the working fluid to a hot vapor via heat transfer. The hot vapor from the second heat exchanger is supplied to at least one turbine or expander after passing through a separator designed to insure no liquid enters said at least one turbine or expander. The hot, high pressure vapor is expanded in the turbine to produce mechanical power on a shaft and is discharged as a hot, low pressure vapor. The hot vapor is then routed back to the economizer heat exchanger and then to a second flow mixer (which may function as a desuperheater) where the hot vapor is mixed with the liquid discharged from the separator and a third portion of the working fluid from the flow divider. The system further comprises a condenser heat exchanger that is adapted to receive the exhaust vapor from the turbine or expander after passing through the economizer heat exchanger and mixing with the liquids from the separator and the flow divider and a cooling fluid circulated by a cooling fluid pump. The system is further comprised of an accumulator vessel to receive the condensed liquid from the condenser and meter said condensate to a liquid working fluid circulating pump that is adapted to circulate the working fluid to a flow divider. The system is finally comprised of a flow divider that is adapted to split the working fluid into at least three portions, at least one that is supplied to an economizer heat exchanger, at least one supplied to a second flow mixer, and at least one that is supplied to a first heat exchanger.

In yet another illustrative embodiment, the system comprises a first heat exchanger adapted to receive a heating stream from a heat source after passing through a second heat exchanger and a second portion of a working fluid, wherein, when the second portion of the working fluid is passed through the first heat exchanger, the second portion of working fluid is converted to a hot liquid via heat transfer from the heat contained in the heating stream from the heat source after passing through a second heat exchanger. The system is further comprised of an economizer heat exchanger adapted to receive a first portion of the working fluid and the hot discharge vapor from at least one turbine. The first and second portions of the working fluid are recombined in a first flow mixer after passing through the economizer heat exchanger and first heat exchanger, respectively. The system is further comprised of a second heat exchanger adapted to receive the working fluid from the first flow mixer and a hot heating stream from a heat source and convert the working fluid to a hot vapor. The hot vapor from the second heat exchanger is supplied to at least one turbine or expander after passing through a separator designed to insure no liquid enters said at least one turbine or expander. The hot, high pressure vapor is expanded in the turbine or expander to produce mechanical power on a shaft and is discharged as a hot, low pressure vapor. The hot vapor is then routed back to the economizer heat exchanger and then to a second flow mixer where the hot vapor is mixed with the liquid discharged from the separator. The system further comprises a condenser heat exchanger that is adapted to receive the exhaust vapor from the turbine or expander after passing through the economizer heat exchanger and mixing with the liquid from the separator and a gaseous cooling media such as air. The system is further comprised of an accumulator vessel to receive the condensed liquid from the condenser and meter said condensate to a liquid working fluid circulating pump that is adapted to circulate the working fluid to a flow divider. The system is finally comprised of a flow divider that is adapted to split the working fluid into at least two portions, at least one that is supplied to an economizer heat exchanger and at least one that is supplied to a first heat exchanger.

In a fourth illustrative embodiment, the system comprises a first heat exchanger adapted to receive a heating stream from a heat source after passing through a second heat exchanger and a second portion of a working fluid, wherein, the second portion of the working fluid is passed through the first heat exchanger, the second portion of working fluid is converted to a hot liquid via heat transfer from the heat contained in the heating stream from the heat source after passing through a second heat exchanger. The system is further comprised of an economizer heat exchanger adapted to receive a first portion of the working fluid and the hot discharge vapor from at least one turbine or one expander. The system is further comprised of a second flow mixer adapted to receive a third portion of the working fluid via a fluid bypass control valve. The first and second portions of the working fluid are recombined in a first flow mixer after passing through the economizer heat exchanger and first heat exchanger, respectively. The system is further comprised of a second heat exchanger adapted to receive the working fluid from the first flow mixer and a hot heating stream from a heat source and heat the working fluid to a hot vapor via heat transfer. The hot vapor from the second heat exchanger is supplied to at least one turbine after passing through a separator designed to insure no liquid enters the said at least one turbine or expander. The hot, high pressure vapor is expanded in the turbine or expander to produce mechanical power on a shaft and is discharged as a hot, low pressure vapor. The hot vapor is then routed back to the economizer heat exchanger and then to a second flow mixer where the hot vapor is mixed with the liquid discharged from the separator and a third portion of the working fluid from the flow divider. The system further comprises a condenser heat exchanger that is adapted to receive the exhaust vapor from the turbine or expander after passing through the economizer heat exchanger and mixing with the liquids from the separator and the flow divider and a gaseous cooling media such as air. The system is further comprised of an accumulator vessel to receive the condensed liquid from the condenser and meter said condensate to a liquid working fluid circulating pump that is adapted to circulate the working fluid to a flow divider. The system is finally comprised of a flow divider that is adapted to split the working fluid into at least three portions, at least one that is supplied to an economizer heat exchanger, at least one supplied to a second flow mixer, and at least one that is supplied to a first heat exchanger.

In all of the illustrative examples, the condenser heat exchanger might be adapted to receive any one or a plurality of cooling fluids such as water from a cooling tower; water from a river or stream; water from a pond, lake, bay, or other freshwater source; seawater from a bay, canal, channel, sea, ocean, or other source; chilled water; fresh air; chilled air; a liquid process stream, e.g. propane; a gaseous process stream, e.g. nitrogen; or other heat sink such as a ground source cooling loop comprised of a plurality of buried pipes.

BRIEF DESCRIPTION OF THE DRAWINGS

The invention may be understood by reference to the following description taken in conjunction with the accompanying drawings, in which like reference numerals identify like elements, and in which.

Figure 1:
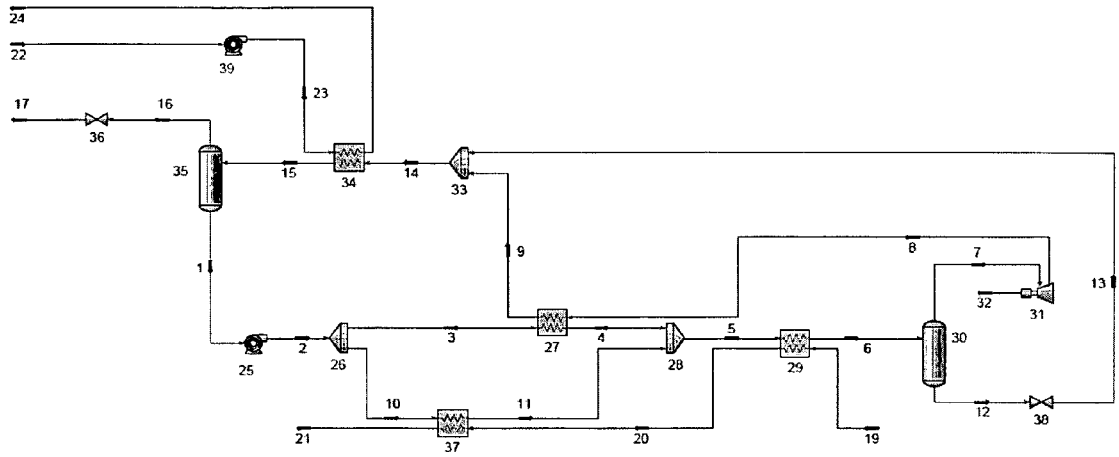
FIG. 1 is a schematic diagram of one illustrative embodiment of the present invention employing a working fluid circulating pump, a flow divider, two heat recovery heat exchangers, an economizer heat exchanger, a first flow mixer, a separator, a turbine or expander, a liquid control valve, a second flow mixer/desuperheater, a liquid cooled condenser heat exchanger, an accumulator, a vent/charge valve, and a cooling liquid circulating pump.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached drawings which are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e. a meaning other than that understood by skilled artisans, such a special definition will be expressly set forth in the specification in a definitional manner that directly and unequivocally provides the special definition for the term or phrase. Moreover, various streams or conditions may be referred to with terms such as "hot," "cold," "cooled, "warm," etc., or other like terminology. Those skilled in the art will recognize that such terms reflect conditions relative to another process stream, not an absolute measurement of any particular temperature.

The present invention is generally related to pending allowed U.S. patent application Ser. No. 10/616,074, now U.S. Pat. No. 6,964,168. That pending application is hereby incorporated by reference in its entirety.

One illustrative embodiment of the present invention will now be described with reference to FIG. 1. As shown therein, a high pressure, liquid working fluid 2 enters a flow divider 26 and is split into two portions 3,10. A first portion 3 of the working fluid enters an economizer heat exchanger 27 adapted to receive a hot vapor discharge 8 from a turbine or expander 31 and the first portion 3 of the working fluid is heated via heat transfer with the hot vapor 8 and exits as a hot liquid 4. For purposes of the present application, the term "turbine" will be understood to include both turbines and expanders or any device wherein useful work is generated by expanding a high pressure gas within the device. A second portion 10 of the working fluid enters a first heat exchanger 37 that is adapted to receive a hot heating stream 20 from a heat source (via line 19) after passing through a second heat exchanger 29. The second portion 10 of the working fluid is heated via heat transfer with the hot heating stream 20 in the first heat exchanger 37. The hot heating stream 20 discharges from the first heat exchanger 37 as a cool vapor 21 that is near or below its dew point. The second portion 10 of the working fluid exits the first heat exchanger as a hot liquid 11. The hot liquid 4 and the hot liquid 11 are mixed in a first flow mixer 28 and discharged as a combined hot liquid stream 5. The combined hot liquid stream 5 is introduced into a second heat exchanger 29 that is adapted to receive a heating stream 19 and exits as a superheated vapor 6 due to heat transfer with a hot fluid, either a gas, a liquid, or a two-phase mixture of gas and liquid entering at 19 and exiting at 20. The vapor 6 may be a subcritical or supercritical vapor.

The heat exchangers 27, 29, and 37 may be any type of heat exchanger capable of transferring heat from one fluid stream to another fluid stream. For example, the heat exchangers 27, 29, and 37 may be shell-and-tube heat exchangers, a plate-fin-tube coil type of exchangers, bare tube or finned tube bundles, welded plate heat exchangers, etc. Thus, the present invention should not be considered as limited to any particular type of heat exchanger unless such limitations are expressly set forth in the appended claims.

The source of the hot heating stream 19 for the second heat exchanger 29 may either be a waste heat source (from any of a variety of sources) or heat may intentionally be supplied to the system, e.g. by a gas burner, a fuel oil burner, or the like. In one illustrative embodiment, the source of the hot heating stream 19 for the second heat exchanger 29 is a waste heat source such as the exhaust from an internal combustion engine (e.g. a reciprocating diesel engine), a combustion gas turbine, a compressor, or an industrial or manufacturing process. However, any heat source of sufficient quantity and temperature may be utilized if it can be obtained economically. In some cases, the first and second heat exchangers 37, 29 may be referred to either as "waste heat recovery heat exchangers," indicating that the source of the heating stream 19 is from what would otherwise be a waste heat source, although the present invention is not limited to such situations, or "heat recovery heat exchangers" indicating that the source of the heating stream 19 is from what would be any heat source.

In one embodiment, the vapor 6 then enters a separator 30 that is designed to protect the turbine 31 from any liquid that might be entrained in the vapor 6 and to separate the normally dry, highly superheated vapor 6 into a dry vapor 7 and a liquid component 12. The liquid component 12 is routed away from the separator 30 via a liquid control valve 38 to prevent accumulation of the liquid in the separator 30. The vapor 7 then enters the turbine (expander) 31. The vapor 7 is expanded in the turbine (expander) 31 and the design of the turbine 31 converts kinetic and potential energy of the dry vapor 7 into mechanical energy in the form of torque on an output shaft 32. Any type of commercially available turbine suited for use in the systems described herein may be employed, e.g. an expander, a turbo-expander, a power turbine, etc. The shaft horsepower available on the shaft 32 of the turbine 31 can be used to produce power by driving one or more generators, compressors, pumps, or other mechanical devices, either directly or indirectly. Several illustrative embodiments of how such useful power may be used are described further in the application. Additionally, as will be recognized by those skilled in the art after a complete reading of the present application, a plurality of turbines 31 or heat recovery heat exchangers 29 or 37 may be employed with the system depicted in FIG. 1.

The low pressure, high temperature discharge 8 from the turbine 31 is routed to an economizer heat exchanger 27 that is adapted to receive the first portion 3 of the liquid working fluid. The economizer heat exchanger 27 cools the hot vapor 8 via heat transfer with the first portion 3 of the liquid working fluid and discharges the hot vapor as a cool vapor 9 at or near its dew point. The cool vapor 9 is routed to a second flow mixer or desuperheater 33 that is adapted to receive the cooled vapor 9 and a hot incidental fluid 13 from the liquid control valve 38. The hot incidental fluid 13, intermittently discharged during startup, shutdown, or upset conditions may be either a liquid or a vapor containing both a liquid and a gas and would not normally be a gas exclusively. After the combination of the cooled vapor 9 and the incidental fluid 13 in the second fluid mixer or desuperheater 33 the combined stream 14 is routed to a condenser heat exchanger 34 that is adapted to receive a cooling fluid 23. The condenser 34 condenses the slightly superheated to partially wet, low pressure vapor 14 and condenses it to the liquid state using water, seawater, or other liquid or boiling fluids 23 which might be circulated by a low pressure liquid circulating pump 39 which provides the necessary motive force to circulate the cooling fluid from point 22 to point 24. The condenser 34 may be utilized to condense the hot working fluid from a vapor 14 to a liquid 15 at a temperature ranging from approximately 50-250° F.

The condensed liquid 15 is introduced into an accumulator drum 35. The drum 35 may serve several purposes, such as, for example: (a) the design of the drum 35 ensures that the pump 25 has sufficient head to avoid cavitation; (b) the design of the drum 35 ensures that the supply of liquid 1 to the pump 25 is steady; (c) the design of the drum 35 ensures that the pump 25 will not be run dry; (d) the design of the drum 35 provides an opportunity to evacuate any non-condensable vapors from the system through a vent valve 36 via lines 16, 17; (e) the design of the drum 35 allows for the introduction of process liquid into the system; and (f) the design of the drum 35 allows for the introduction of makeup quantities of the process liquid in the event that a small amount of operating fluid is lost. The high pressure discharge 2 of the pump 25 is fed to the first flow divider 26. The pump 25 may be any type of commercially available pump sufficient to meet the pumping requirements of the systems disclosed herein. In various embodiments, the pump 25 may be sized such that the discharge pressure of the working fluid ranges from approximately 300 psia to 1500 psia. In the most preferred embodiment, the selection of the discharge pressure of the pump 25 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

In the illustrative embodiment depicted in FIG. 1, the working fluid enters the first heat recovery heat exchanger 37 and the economizer heat exchanger 27 as a cool, high pressure liquid and, after being recombined, leaves as a hot liquid 5. The working fluid 5 then enters the second heat recovery heat exchanger 29 and leaves as a superheated vapor 6. The high pressure, superheated vapor 6 is then expanded through a turbine 31 to produce mechanical power after passing through a separator 30 and split into a dry vapor 7 and a liquid 12. The vapor 8 exiting the turbine 31 is at low pressure and in the superheated state and the vapor 8 is passed through the economizer heat exchanger 27 and the second fluid mixer 33. In some applications, the second fluid mixer 33 may function as a desuperheater. After the second fluid mixer 33, the vapor is then introduced into the condenser heat exchanger 34 which may be water cooled, air cooled, evaporatively cooled, or used as a heat source for district heating, domestic hot water, or similar heating load. The condensed low pressure liquid 15 is fed to the suction of a pump 25 via drum 35 and is pumped to the high pressure required for the first heat recovery heat exchanger 37 and the economizer heat exchanger 27.

The present invention may employ a single component working fluid that may be comprised of, for example, ammonia (NH3), bromine (Br2), carbon tetrachloride (CCl4), ethyl alcohol or ethanol (CH3CH2OH, C2H6O), furan (C4H4O), hexafluorobenzene or perfluorobenzene (C6F6), hydrazine (N2H4), methyl alcohol or methanol ($CH_3OH$), monochlorobenzene or chlorobenzene or chlorobenzol or benzine chloride (C6H5Cl), n-pentane or normal pentane (nC5), i-hexane or isohexane (iC5), pyridene or azabenzene (C5H5N), refrigerant 11 or freon 11 or CFC-11 or R-11 or trichlorofluoromethane (CCl3F), refrigerant 12 or freon 12 or R-12 or dichlorodifluoromethane (CCl2F2), refrigerant 21 or freon 21 or CFC-21 or R-21 (CHCl2F), refrigerant 30 or freon 30 or CFC-30 or R-30 or dichloromethane or methylene chloride or methylene dichloride (CH2Cl2), refrigerant 115 or freon 115 or CFC-115 or R-115 or chloropentafluoroethane or monochloropentafluoroethane, refrigerant 123 or freon 123 or HCFC-123 or R-123 or 2,2 dichloro-1,1,1-trifluoroethane, refrigerant 123*a* or freon 123a or HCFC-123a or R-123a or 1,2-dichloro-1,1,2-trifluoroethane, refrigerant 123b1 or freon 123b1 or HCFC-123b1 or R-123b1 or halothane or 2-bromo-2-chloro-1,1,1-trifluoroethane, refrigerant 134A or freon 134A or HFC-134A or R-134A or 1,1,1,2-tetrafluoroethane, refrigerant 150A or freon 150A or CFC-150A or R-150A or dichloroethane or ethylene dichloride ($CH_3CHC12$), thiophene (C4H4S), toluene or methylbenzene or phenylmethane or toluol (C7H8), water (H2O), etc. In some applications, the working fluid may be comprised of multiple components. For example, one or more of the compounds identified above may be combined or with a hydrocarbon fluid, e.g. isobutene, etc. Further, several simple hydrocarbons compounds may be combined such as isopentane, toluene, and hexane to create a working fluid. In the context of the present application, reference may be made to the use of methyl alcohol or methanol as the working fluid and to provide certain illustrative examples. However, after a complete reading of the present application, those skilled in the art will recognize that the present invention is not limited to any particular type of working fluid or refrigerant. Thus, the present invention should not be considered as limited to any particular working fluid unless such limitations are clearly set forth in the appended claims.

In the present invention, as the working fluid 5 passes through the second heat recovery heat exchanger 29, it changes from a liquid state to a vapor state in a non-isothermal process using an approximately linear temperature-enthalpy profile, i.e., the slope of the temperature-enthalpy curve does not change significantly even though the working fluid changes state from a subcooled liquid to a superheated vapor. The slope of the temperature-enthalpy graph may vary depending upon the application. Moreover, the temperature-enthalpy profile may not be linear over the entire range of the curve.

The temperature-enthalpy profile of the working fluid of the present invention is fundamentally different from other systems. For example, a temperature-enthalpy profile for a typical Rankine cycle undergoes one or more essentially isothermal (constant temperature) boiling processes as the working fluid changes from a liquid state to a vapor state. Other systems, such as a Kalina cycle, may exhibit a more non-isothermal conversion of the working fluid from a liquid state to a vapor state, but such systems employ binary component working fluids, such as ammonia and water.

The non-isothermal process used in practicing aspects of the present invention is very beneficial in that it provides a greater heat capacity that may be recaptured when the vapor is cooled back to a liquid. That is, due to the higher temperatures involved in such a non-isothermal process, the working fluid, in the superheated vapor state, contains much more useable heat energy that may be recaptured and used for a variety of purposes. Further, the nearly linear temperature-enthalpy profile allows the exiting temperature of the (waste) heat source to approach more closely to the working fluid temperature 2,10 entering the first heat recovery heat exchanger 37.

By way of example, with reference to FIG. 1, in one illustrative embodiment where the working fluid is methyl alcohol or methanol, the temperature of the working fluid at point 2 may be between approximately 50-250° F. at approximately 1120 psia to 1220 psia at the discharge of the pump 25. The working fluid at point 15 may be at a pressure of approximately 1 psia to 92 psia at the discharge of the condenser 34 (see FIG. 1) for a system pressure ratio of between approximately between twelve to one (12:1) and one thousand two hundred and twenty to one (1220:1). In one particularly illustrative embodiment, the pressure ratio would be as large as practical. The temperature of the methanol working fluid 6 at the exit of the heat exchanger 29 may be approximately 500-1000° F. or more. The temperature of the methanol working fluid 8 at the exit of the turbine 31 may be between approximately 90° F. (at a pressure of approximately 3 psia) and 670° F. (at a pressure of approximately 92 psia). The temperature of the methanol working fluid 8 at the exit of the turbine 31 may be superheated by between approximately 10° F. (at a pressure of approximately 8 psia when the vapor 7 entering the turbine 31 is at 650° F.) and approximately 415° F. (at a pressure of 92 psia when the vapor 7 entering the turbine 31 is at 1000° F.). The amount of superheat at 8 is functionally related to the pressure ratio of the system, the efficiency of the turbine 31, the thermodynamic properties of the working fluid, the degree of superheat at 7 entering the turbine 31, the flow ratio of the streams 3,10 exiting the flow divider 26, and the hot heating stream discharge temperature 21. In one particularly illustrative embodiment of the present invention, the temperature of the working fluid at point 8 exiting the turbine 31 will be selected, along with other parameters, to produce a condenser 34 inlet temperature as close as possible to the dew point of the working fluid 14 at the conditions entering the condenser 34. The present embodiment will allow large amounts of superheat at 7 and at 8 and still remain more efficient than previous, related art.

In another illustrative embodiment where the working fluid is bromine, the temperature of the working fluid at point 2 may be between approximately 50-250° F. at approximately 1540 psia at the discharge of the pump 25. The working fluid at point 15 may be at a pressure of approximately 11 psia at the discharge of the condenser 34 for a system pressure ratio of approximately one hundred and forty to one (140:1). The temperature of the bromine working fluid 6 at the exit of the heat exchanger 29 may be approximately 650-1000° F. The temperature of the bromine working fluid 8 at the exit of the turbine 31 may be approximately 130° F. at a pressure of approximately 13 psia.

In another illustrative embodiment where the working fluid is carbon tetrachloride, the temperature of the working fluid at point 2 may be between approximately 50-250° F. at approximately 690 psia at the discharge of the pump 25. The working fluid at point 15 may be at a pressure of approximately 6 psia at the discharge of the condenser 34 for a system pressure ratio of approximately one hundred thirty to one (130:1). The temperature of the carbon tetrachloride working fluid 6 at the exit of the heat exchanger 29 may be approximately 550-770° F. The temperature of the carbon tetrachloride working fluid 8 at the exit of the turbine 31 may be approximately 155-400° F. at a pressure of approximately 8 psia.

In another illustrative embodiment where the working fluid is ethyl alcohol or ethanol, the temperature of the working fluid at point 2 may be between approximately 50-250° F. at approximately 1000 psia at the discharge of the pump 25. The working fluid at point 15 may be at a pressure of approximately 4 psia at the discharge of the condenser 34 for a system pressure ratio of approximately two hundred and fifty to one (250:1). The temperature of the ethyl alcohol or ethanol working fluid 6 at the exit of the heat exchanger 29 may be approximately 500-800° F. The temperature of the ethyl alcohol or ethanol working fluid 8 at the exit of the turbine 31 may be approximately 135-400° F. at a pressure of approximately 6 psia.

In another illustrative embodiment where the working fluid is R-150A, the temperature of the working fluid at point 2 may be between approximately 50-250° F. at approximately 770 psia at the discharge of the pump 25. The working fluid at point 15 may be at a pressure of approximately 11 psia at the discharge of the condenser 34 for a system pressure ratio of approximately seventy to one (70:1). The temperature of the R-150A working fluid 6 at the exit of the heat exchanger 29 may be approximately 500-705° F. The temperature of the R-150A working fluid 8 at the exit of the turbine 31 may be approximately 155-400° F. at a pressure of approximately 13 psia.

In another illustrative embodiment where the working fluid is thiophene, the temperature of the working fluid at point 2 may be between approximately 50-250° F. at approximately 900 psia at the discharge of the pump 25. The working fluid at point 15 may be at a pressure of approximately 4.5 psia at the discharge of the condenser 34 for a system pressure ratio of approximately two hundred to one (200:1). The temperature of the thiophene working fluid 6 at the exit of the heat exchanger 29 may be approximately 600-730° F. The temperature of the thiophene working fluid 8 at the exit of the turbine 31 may be approximately 220-400° F. at a pressure of approximately 6.5 psia.

In another illustrative embodiment where the working fluid is a mixture of hydrocarbon compounds, the temperature of the working fluid at point 2 may be between approximately 50-250° F. at approximately 576 psia at the discharge of the pump 25. The working fluid at point 15 may be at a pressure of approximately 36 psia at the discharge of the condenser 34 for a system pressure ratio of approximately sixteen to one (16:1). The temperature of the mixture of hydrocarbon compounds working fluid 6 at the exit of the heat exchanger 29 may be approximately 520-655° F. The temperature of the mixture of hydrocarbon compounds working fluid 8 at the exit of the turbine 31 may be approximately 375-550° F. at a pressure of approximately 38 psia. For this illustrative example, the mixture of hydrocarbons on a molar basis is approximately 10% propane, 10% isobutane, 10% isopentane, 20% hexane, 20% heptane, 10% octane, 10% nonane, and 10% decane. This mixture is one of an infinite number of possible mixtures that might be selected to suit specific needs of a particular embodiment and is in no way representative of the only or best solution.

The methods and systems described herein may be most effective for pressure ratios greater than three to one (3:1) and the pressure ratio is determined by the physical characteristics of the working fluid being utilized. The specific embodiments of this invention significantly improve the efficiency of the specific embodiments of this invention over the previous inventions of the prior art and of this specific art to allow usage at almost any pressure ratio. The specific selection of the low cycle pressure is determined by the condensing pressure of the working fluid and will be, typically, the saturation pressure of the working fluid at between approximately 0-250° F., depending on the cooling medium or condenser heat exchanger type and the ambient temperature or ultimate heat sink temperature. The specific selection of the high cycle pressure is determined by the thermodynamic properties of the working fluid plus a margin, as a minimum, and by cycle efficiency, pump power consumption, and maximum component design pressures as a maximum.

In another illustrative embodiment of the present invention a system substantially similar to FIG. 1 will now be described with reference to FIG. 3. As shown therein, a high pressure, liquid working fluid 2 enters a flow divider 26 and is split into three portions 3,10,40. A first portion 3 of the working fluid enters the economizer heat exchanger 27 that is adapted to receive the hot vapor discharge 8 from the turbine 31 wherein the working fluid 3 is heated via heat transfer with the hot vapor 8 and exits as a hot liquid 4. A second portion 10 of the working fluid enters the first heat exchanger 37 that is adapted to receive the hot heating stream 20 from the heat source (via line 19) after passing through a second heat exchanger 29, wherein the working fluid 10 is heated to a hot liquid 11 via heat transfer with the hot heating stream 20, that ultimately discharges from the first heat exchanger 37 as a cool vapor 21 near or below its dew point. A third portion 40 of the working fluid is routed to a second fluid mixer 33 (which may function as a desuperheater in some cases) that is adapted to receive a portion of the working fluid 42, a cool vapor 9 from the economizer heat exchanger 27, and the incidental liquid 13 from the separator 30. The hot liquid 4 and the hot liquid 11 are mixed in a first flow mixer 28 and discharged as a combined hot liquid stream 5. The combined hot liquid stream 5 is introduced into the second heat exchanger 29 that is adapted to receive the heating stream 19 and exits as a superheated vapor 6 due to heat transfer with a hot fluid, either a gas, a liquid, or a two-phase mixture of gas and liquid entering at 19 and exiting at 20. The vapor 6 may be a subcritical or supercritical vapor.

The heat exchangers 27, 29, and 37 may be any type of heat exchanger capable of transferring heat from one fluid stream to another fluid stream. For example, the heat exchangers 27, 29, and 37 may be shell-and-tube heat exchangers, a plate-fin-tube coil type of exchangers, bare tube or finned tube bundles, welded plate heat exchangers, etc. Thus, the present invention should not be considered as limited to any particular type of heat exchanger unless such limitations are expressly set forth in the appended claims.

The source of the hot heating stream 19 for the second heat exchanger 29 may either be a waste heat source (from any of a variety of sources) or heat may intentionally be supplied to the system, e.g. by a gas burner, a fuel oil burner, or the like. In one illustrative embodiment, the source of the hot heating stream 19 for the second heat exchanger 29 is a waste heat source such as the exhaust from an internal combustion engine (e.g. a reciprocating diesel engine), a combustion gas turbine, a compressor, or an industrial or manufacturing process. However, any heat source of sufficient quantity and temperature may be utilized if it can be obtained economically. In some cases, the first and second heat exchangers 37, 29 may be referred to either as "waste heat recovery heat exchangers," indicating that the source of the heating stream 19 is from what would otherwise be a waste heat source, although the present invention is not limited to such situations, or "heat recovery heat exchangers" indicating that the source of the heating stream 19 is from what would be any heat source.

In one embodiment, the vapor 6 then enters the separator 30 that is designed to protect the turbine 31 from any liquid that might be in the vapor 6 and to separate the normally dry, highly superheated vapor 6 into a dry vapor 7 and a liquid component 12. The liquid component 12 is routed away from the separator 30 via a liquid control valve 38 to prevent accumulation of the liquid in the separator 30. The vapor 7 then enters the turbine (expander) 31. The vapor 7 is expanded in the turbine (expander) 31 and the design of the turbine 31 converts kinetic and potential energy of the dry vapor 7 into mechanical energy in the form of torque on an output shaft 32. Any type of commercially available turbine suited for use in the systems described herein may be employed, e.g. an expander, a turbo-expander, a power turbine, etc. The shaft horsepower available on the shaft 32 of the turbine 31 can be used to produce power by driving one or more generators, compressors, pumps, or other mechanical devices, either directly or indirectly. Several illustrative embodiments of how such useful power may be used are described further in the application. Additionally, as will be recognized by those skilled in the art after a complete reading of the present application, a plurality of turbines 31 or heat recovery heat exchangers 29 or 37 may be employed with the system depicted in FIG. 3.

The low pressure, high temperature discharge 8 from the turbine 31 is routed to the economizer heat exchanger 27 that is adapted to receive the first portion 3 of the liquid working fluid. The economizer heat exchanger 27 cools the hot vapor 8 via heat transfer with the first portion 3 of the liquid working fluid and discharges the hot vapor as a cool vapor 9 at or near its dew point. The cool vapor 9 is routed to a second fluid mixer or desuperheater 33 that is adapted to receive the cooled vapor 9, a hot incidental fluid 13 from the liquid control valve 38, and a portion of the cool, liquid working fluid 42 after the liquid flows through a liquid bypass control valve 41 and a line 40. The hot incidental fluid 13, intermittently discharged during startup, shutdown, or upset conditions may be either a liquid or a vapor containing both a liquid and a gas and would not normally be a gas exclusively. After the combination of the cooled vapor 9, the incidental fluid 13, and the working fluid 42 in the second fluid mixer or desuperheater 33 the combined stream 14 is routed to a condenser heat exchanger 34 that is adapted to receive a cooling fluid 23. The condenser 34 condenses the slightly superheated to partially wet, low pressure vapor 14 to the liquid state using water, seawater, or other liquid or boiling fluids 23 which might be circulated by a low pressure liquid circulating pump 39 which provides the necessary motive force to circulate the cooling fluid from point 22 to point 24. The condenser 34 may be utilized to condense the hot working fluid from a vapor 14 to a liquid 15 at a temperature ranging from approximately 0-250° F.

The condensed liquid 15 is introduced into an accumulator drum 35. The drum 35 may serve several purposes, such as, for example: (a) the design of the drum 35 ensures that the pump 25 has sufficient head to avoid cavitation; (b) the design of the drum 35 ensures that the supply of liquid 1 to the pump 25 is steady; (c) the design of the drum 35 ensures that the pump 25 will not be run dry; (d) the design of the drum 35 provides an opportunity to evacuate any non-condensable vapors from the system through a vent valve 36 via lines 16, 17; (e) the design of the drum 35 allows for the introduction of process liquid into the system; and (f) the design of the drum 35 allows for the introduction of makeup quantities of process liquid in the event that a small amount of operating fluid is lost. The high pressure discharge 2 of the pump 25 is fed to the first flow divider 26. The pump 25 may be any type of commercially available pump sufficient to meet the pumping requirements of the systems disclosed herein. In various embodiments, the pump 25 may be sized such that the discharge pressure of the working fluid ranges from approximately 300 psia to 1500 psia. In one particularly illustrative embodiment, the selection of the discharge pressure of the pump 25 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

Figure 3:
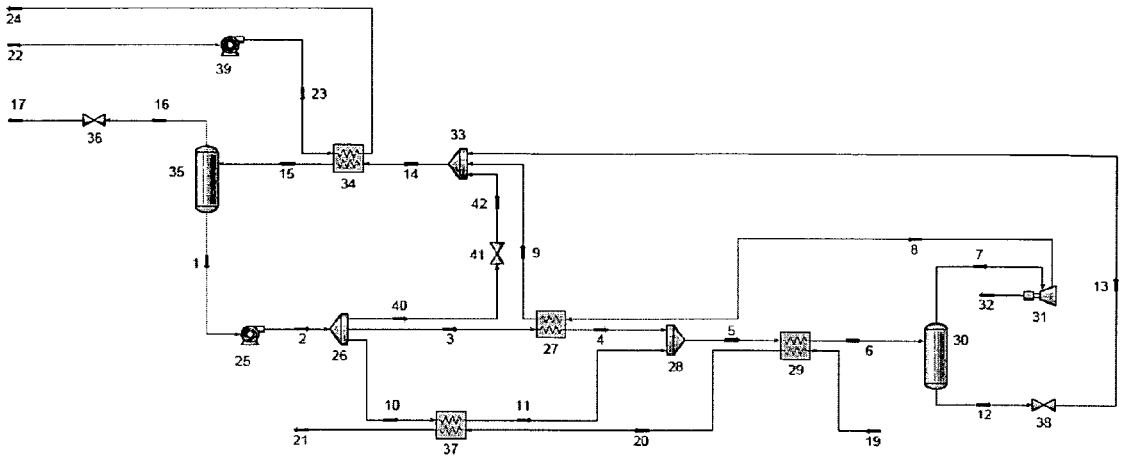
FIG. 3 is a schematic diagram of one illustrative embodiment of the present invention employing a working fluid circulating pump, a flow divider, two heat recovery heat exchangers, an economizer heat exchanger, a first flow mixer, a separator, a turbine or expander, a liquid control valve, a liquid desuperheater feed bypass flow control valve, a second flow mixer/desuperheater, a liquid cooled condenser heat exchanger, an accumulator, a vent/charge valve, and a cooling liquid circulating pump.

In the illustrative embodiment depicted in FIG. 3, the working fluid enters the first heat recovery heat exchanger 37 and the economizer heat exchanger 27 as a cool, high pressure liquid and, after being recombined in the first flow mixer 28, leaves as a hot liquid 5. The working fluid 5 then enters the second heat recovery heat exchanger 29 and leaves as a superheated vapor 6. The high pressure, superheated vapor 6 is then expanded through a turbine 31 to produce mechanical power after passing through a separator 30 and split into a dry vapor 7 and a liquid 12. The vapor 8 exiting the turbine 31 is at low pressure and in the superheated state, and it is passed through the economizer heat exchanger 27 and the second fluid mixer 33. After the second fluid mixer 33, vapor is then introduced into the condenser heat exchanger 34 which may be water cooled, air cooled, evaporatively cooled, or used as a heat source for district heating, domestic hot water, or similar heating load. The condensed low pressure liquid 15 is fed to the suction of a pump 25 via a drum 35 and is pumped to the high pressure required for the first heat recovery heat exchanger 37, the economizer heat exchanger 27 and the liquid bypass valve 41.

As described above, the present invention may employ a single component working fluid that may be comprised of any of the previously mentioned or similar fluids. After a complete reading of the present application, those skilled in the art will recognize that the present invention is not limited to any particular type of working fluid or refrigerant. Thus, the present invention should not be considered as limited to any particular working fluid unless such limitations are clearly set forth in the appended claims.

In another illustrative embodiment of the present invention a system substantially similar to FIG. 1 will now be described with reference to FIG. 2. As shown therein, a high pressure, liquid working fluid 2 enters the flow divider 26 and is split into two portions 3,10. A first portion 3 of the working fluid enters the economizer heat exchanger 27 that is adapted to receive a hot vapor discharge 8 from the turbine 31, wherein the working fluid 3 is heated via heat transfer with the hot vapor 8 and exits as a hot liquid 4. A second portion 10 of the working fluid enters the first heat exchanger 37 that is adapted to receive the hot heating stream 20 from a heat source after passing through a second heat exchanger 29, wherein the working fluid 10 is heated to a hot liquid 11 via heat transfer with the hot heating stream 20, that ultimately discharges as a cool vapor 21 near or below its dew point. The hot liquid 4 and the hot liquid 11 are mixed in the first flow mixer 28 and discharged as a combined hot liquid stream 5. The combined hot liquid stream 5 is introduced into the second heat exchanger 29 that is adapted to receive the heating stream 19 and exits as a superheated vapor 6 due to heat transfer with a hot fluid, either a gas, a liquid, or a two-phase mixture of gas and liquid entering at 19 and exiting at 20. The vapor 6 may be a subcritical or supercritical vapor.

The heat exchangers 27, 29, and 37 may be any type of heat exchanger capable of transferring heat from one fluid stream to another fluid stream. For example, the heat exchangers 27, 29, and 37 may be shell-and-tube heat exchangers, a plate-fin-tube coil type of exchangers, bare tube or finned tube bundles, welded plate heat exchangers, etc. Thus, the present invention should not be considered as limited to any particular type of heat exchanger unless such limitations are expressly set forth in the appended claims.

The source of the hot heating stream 19 for the second heat exchanger 29 may either be a waste heat source (from any of a variety of sources) or heat may intentionally be supplied to the system, e.g. by a gas burner, a fuel oil burner, or the like. In one illustrative embodiment, the source of the hot heating stream 19 for the second heat exchanger 29 is a waste heat source such as the exhaust from an internal combustion engine (e.g. a reciprocating diesel engine), a combustion gas turbine, a compressor, or an industrial or manufacturing process. However, any heat source of sufficient quantity and temperature may be utilized if it can be obtained economically. In some cases, the first and second heat exchangers 37, 29 may be referred to either as "waste heat recovery heat exchangers," indicating that the source of the heating stream 19 is from what would otherwise be a waste heat source, although the present invention is not limited to such situations, or "heat recovery heat exchangers" indicating that the source of the heating stream 19 is from what would be any heat source.

In one embodiment, the vapor 6 then enters the separator 30 that is designed to protect the turbine 31 from any liquid that might be in the vapor 6 and to separate the normally dry, highly superheated vapor 6 into a dry vapor 7 and a liquid component 12. The liquid component 12 is routed away from the separator 30 via the liquid control valve 38 to prevent accumulation of the liquid in the separator 30. The vapor 7 then enters the turbine (expander) 31. The vapor 7 is expanded in the turbine (expander) 31 and the design of the turbine 31 converts kinetic and potential energy of the dry vapor 7 into mechanical energy in the form of torque on an output shaft 32. Any type of commercially available turbine suited for use in the systems described herein may be employed, e.g. an expander, a turbo-expander, a power turbine, etc. The shaft horsepower available on the shaft 32 of the turbine 31 can be used to produce power by driving one or more generators, compressors, pumps, or other mechanical devices, either directly or indirectly. Several illustrative embodiments of how such useful power may be used are described further in the application. Additionally, as will be recognized by those skilled in the art after a complete reading of the present application, a plurality of turbines 31 or heat recovery heat exchangers 29 or 37 may be employed with the system depicted in FIG. 2.

The low pressure, high temperature discharge 8 from the turbine 31 is routed to an economizer heat exchanger 27 adapted to receive a first portion 3 of the liquid working fluid. The economizer heat exchanger 27 cools the hot vapor 8 via heat transfer with the first portion 3 of the liquid working fluid and discharges the hot vapor as a cool vapor 9 at or near its dew point. The cool vapor 9 is routed to a second fluid mixer or desuperheater 33 that is adapted to receive the cooled vapor 9 and a hot incidental fluid 13 from the liquid control valve 38. The hot incidental fluid 13, intermittently discharged during startup, shutdown, or upset conditions may be either a liquid or a vapor containing both a liquid and a gas and would not normally be a gas exclusively. After the combination of the cooled vapor 9 and the incidental fluid 13 in the second fluid mixer or desuperheater 33 the combined stream 14 is routed to a condenser heat exchanger 43 adapted to be gas cooled. The condenser 43 condenses the slightly superheated to partially wet, low pressure vapor 14 to the liquid state using air, nitrogen, hydrogen, or other gas. The condenser 43 may be utilized to condense the hot working fluid from a vapor 14 to a liquid 15 at a temperature ranging from approximately 0-250° F.

The condensed liquid 15 is introduced into an accumulator drum 35. The drum 35 may serve several purposes, such as, for example: (a) the design of the drum 35 ensures that the pump 25 has sufficient head to avoid cavitation; (b) the design of the drum 35 ensures that the supply of liquid 1 to the pump 25 is steady; (c) the design of the drum 35 ensures that the pump 25 will not be run dry; (d) the design of the drum 35 provides an opportunity to evacuate any non-condensable vapors from the system through a vent valve 36 via lines 16, 17; (e) the design of the drum 35 allows for the introduction of process liquid into the system; and (f) the design of the drum 35 allows for the introduction of makeup quantities of liquid in the event that a small amount of operating fluid is lost. The high pressure discharge 2 of the pump 25 is fed to the first flow divider 26. The pump 25 may be any type of commercially available pump sufficient to meet the pumping requirements of the systems disclosed herein. In various embodiments, the pump 25 may be sized such that the discharge pressure of the working fluid ranges from approximately 300 psia to 1500 psia. In the most preferred embodiment, the selection of the discharge pressure of the pump 25 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

Figure 2:
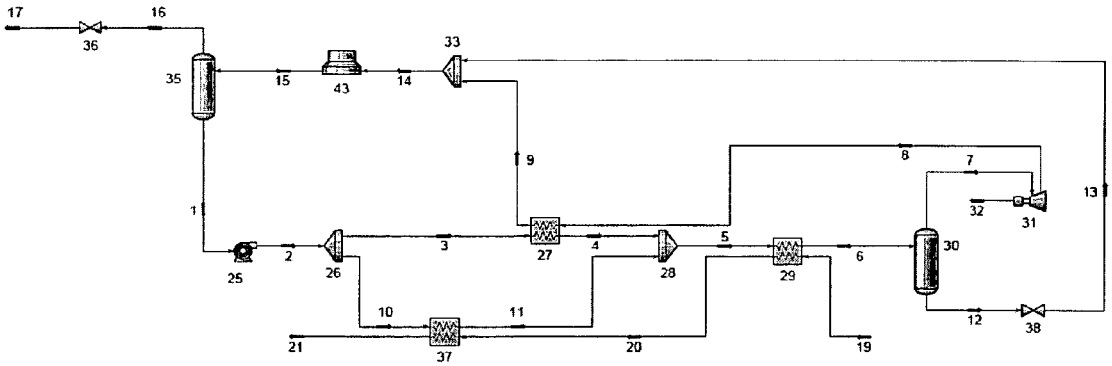
FIG. 2 is a schematic diagram of one illustrative embodiment of the present invention employing a working fluid circulating pump, a flow divider, two heat recovery heat exchangers, an economizer heat exchanger, a first flow mixer, a separator, a turbine or expander, a liquid control valve, a second flow mixer/desuperheater, a gas cooled condenser heat exchanger, an accumulator, and a vent/charge valve.

In the illustrative embodiment depicted in FIG. 2, the working fluid (3, 10) enters the first heat recovery heat exchanger 37 and the economizer heat exchanger 27 as a cool, high pressure liquid and leaves (after being combined) as a hot liquid 5. The working fluid 5 then enters the second heat recovery heat exchanger 29 and leaves as a superheated vapor 6. The high pressure, superheated vapor 6 is then expanded through a turbine 31 to produce mechanical power after passing through a separator 30 and split into a dry vapor 7 and a liquid 12. The vapor 8 exiting the turbine 31 is at low pressure and in the superheated state and is passed through the economizer heat exchanger 27 and the second fluid mixer 33. Thereafter, this vapor is then introduced into the condenser heat exchanger 43 that is adapted to be gas cooled. The condensed low pressure liquid 15 is fed to the suction of a pump 25 via a drum 35 and is pumped to the high pressure required for the first heat recovery heat exchanger 37 and the economizer heat exchanger 27.

After a complete reading of the present application, those skilled in the art will recognize that the present invention is not limited to any particular type of working fluid or refrigerant. Thus, the present invention should not be considered as limited to any particular working fluid unless such limitations are clearly set forth in the appended claims.

In another illustrative embodiment of the present invention a system substantially similar to FIG. 3 will now be described with reference to FIG. 4. As shown therein, a high pressure, liquid working fluid 2 enters a flow divider 26 and is split into three portions 3,10,40. A first portion 3 of the working fluid enters the economizer heat exchanger 27 that is adapted to receive a hot vapor discharge 8 from a turbine 31, wherein the working fluid 3 is heated via heat transfer with the hot vapor 8 and exits as a hot liquid 4. A second portion 10 of the working fluid enters the first heat exchanger 37 that is adapted to receive the hot heating stream 20 from the heat source 19 after passing through a second heat exchanger 29, wherein the working fluid 10 is heated to a hot liquid via heat transfer with the hot heating stream 20, that ultimately discharges from the first heat exchanger 37 as a cool vapor 21 near or below its dew point. A third portion 40 of the working fluid is routed to a second fluid mixer 33 that is adapted to receive a portion 40 of the working fluid 42, a cool vapor 9 from the economizer heat exchanger 27, and an incidental liquid 13 from the separator 30. The hot liquid 4 and the hot liquid 11 are mixed in a first flow mixer 28 and discharged as a combined hot liquid stream 5. The combined hot liquid stream 5 is introduced into the second heat exchanger 29 that is adapted to receive the heating stream 19 and exits as a superheated vapor 6 due to heat transfer with a hot fluid, either a gas, a liquid, or a two-phase mixture of gas and liquid entering at 19 and exiting at 20. The vapor 6 may be a subcritical or supercritical vapor.

The heat exchangers 27, 29, and 37 may be any type of heat exchanger capable of transferring heat from one fluid stream to another fluid stream. For example, the heat exchangers 27, 29, and 37 may be shell-and-tube heat exchangers, a plate-fin-tube coil type of exchangers, bare tube or finned tube bundles, welded plate heat exchangers, etc. Thus, the present invention should not be considered as limited to any particular type of heat exchanger unless such limitations are expressly set forth in the appended claims.

The source of the hot heating stream 19 for the second heat exchanger 29 may either be a waste heat source (from any of a variety of sources) or heat may intentionally be supplied to the system, e.g. by a gas burner, a fuel oil burner, or the like. In one illustrative embodiment, the source of the hot heating stream 19 for the second heat exchanger 29 is a waste heat source such as the exhaust from an internal combustion engine (e.g. a reciprocating diesel engine), a combustion gas turbine, a compressor, or an industrial or manufacturing process. However, any heat source of sufficient quantity and temperature may be utilized if it can be obtained economically. In some cases, the first and second heat exchangers 37, 29 may be referred to either as "waste heat recovery heat exchangers," indicating that the source of the heating stream 19 is from what would otherwise be a waste heat source, although the present invention is not limited to such situations, or "heat recovery heat exchangers" indicating that the source of the heating stream 19 is from what would be any heat source.

In one embodiment, the vapor 6 then enters the separator 30 that is designed to protect the turbine 31 from any liquid that might be in the vapor 6 and to separate the normally dry, highly superheated vapor 6 into a dry vapor 7 and a liquid component 12. The liquid component 12 is routed away from the separator via a liquid control valve 38 to prevent accumulation of the liquid in the separator 30. The vapor 7 then enters the turbine (expander) 31. The vapor 7 is expanded in the turbine (expander) 31 and the design of the turbine 31 converts kinetic and potential energy of the dry vapor 7 into mechanical energy in the form of torque on an output shaft 32. Any type of commercially available turbine suited for use in the systems described herein may be employed, e.g. an expander, a turbo-expander, a power turbine, etc. The shaft horsepower available on the shaft 32 of the turbine 31 can be used to produce power by driving one or more generators, compressors, pumps, or other mechanical devices, either directly or indirectly. Several illustrative embodiments of how such useful power may be used are described further in the application. Additionally, as will be recognized by those skilled in the art after a complete reading of the present application, a plurality of turbines 31 or heat recovery heat exchangers 29 or 37 may be employed with the system depicted in FIG. 4.

The low pressure, high temperature discharge 8 from the turbine 31 is routed to an economizer heat exchanger 27 that is adapted to receive the first portion 3 of the liquid working fluid. The economizer heat exchanger 27 cools the hot vapor 8 via heat transfer with the first portion 3 of the liquid working fluid and discharges the hot vapor as a cool vapor 9 at or near its dew point. The cool vapor 9 is routed to a second fluid mixer 33 that is adapted to receive the cooled vapor 9, a hot incidental fluid 13 from the liquid control valve 38, and a portion of the cool, liquid working fluid 42 after the liquid flows through a liquid bypass control valve 41 and a line 40. The hot incidental fluid 13, intermittently discharged during startup, shutdown, or upset conditions may be either a liquid or a vapor containing both a liquid and a gas and would not normally be a gas exclusively. After the combination of the cooled vapor 9, the incidental fluid 13, and the working fluid 42 in the second fluid mixer or desuperheater 33 the combined stream 14 is routed to a condenser heat exchanger 43 that is adapted to be gas cooled. The condenser 43 condenses the slightly superheated to partially wet, low pressure vapor 14 and condenses it to the liquid state using air, nitrogen, hydrogen, or other gas. The condenser 43 may be utilized to condense the hot working fluid from a vapor 14 to a liquid 15 at a temperature ranging from approximately 0-250° F.

The condensed liquid 15 is introduced into an accumulator drum 35. The drum 35 may serve several purposes, such as, for example: (a) the design of the drum 35 ensures that the pump 25 has sufficient head to avoid cavitation; (b) the design of the drum 35 ensures that the supply of liquid 1 to the pump 25 is steady; (c) the design of the drum 35 ensures that the pump 25 will not be run dry; (d) the design of the drum 35 provides an opportunity to evacuate any non-condensable vapors from the system through a vent valve 36 via lines 16, 17; (e) the design of the drum 35 allows for the introduction of process liquid into the system; and (f) the design of the drum 35 allows for the introduction of makeup quantities of process liquid in the event that a small amount of operating fluid is lost. The high pressure discharge 2 of the pump 25 is fed to the first flow divider 26. The pump 25 may be any type of commercially available pump sufficient to meet the pumping requirements of the systems disclosed herein. In various embodiments, the pump 25 may be sized such that the discharge pressure of the working fluid ranges from approximately 300 psia to 1500 psia. In one particularly illustrative embodiment, the selection of the discharge pressure of the pump 25 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

Figure 4:
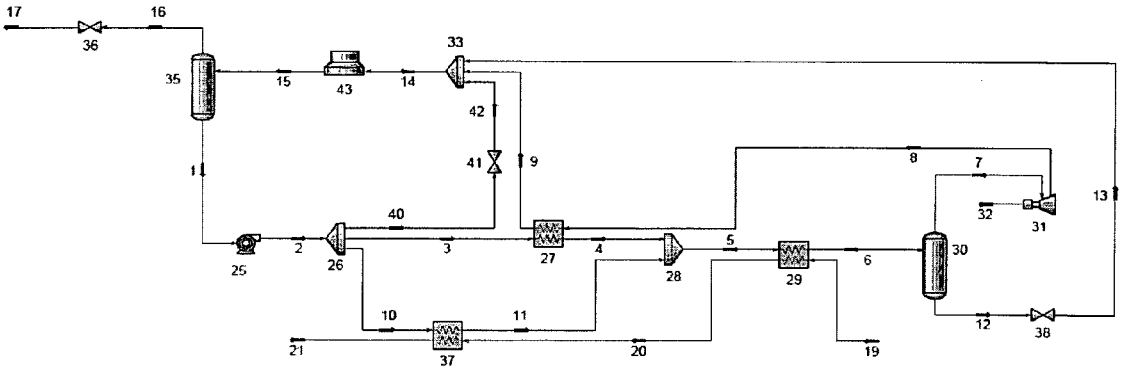
FIG. 4 is a schematic diagram of one illustrative embodiment of the present invention employing a working fluid circulating pump, a flow divider, two heat recovery heat exchangers, an economizer heat exchanger, a first flow mixer, a separator, a turbine or expander, a liquid control valve, a liquid desuperheater feed bypass flow control valve, a second flow mixer/desuperheater, a gas cooled condenser heat exchanger, an accumulator, and a vent/charge valve.
Figure 5:
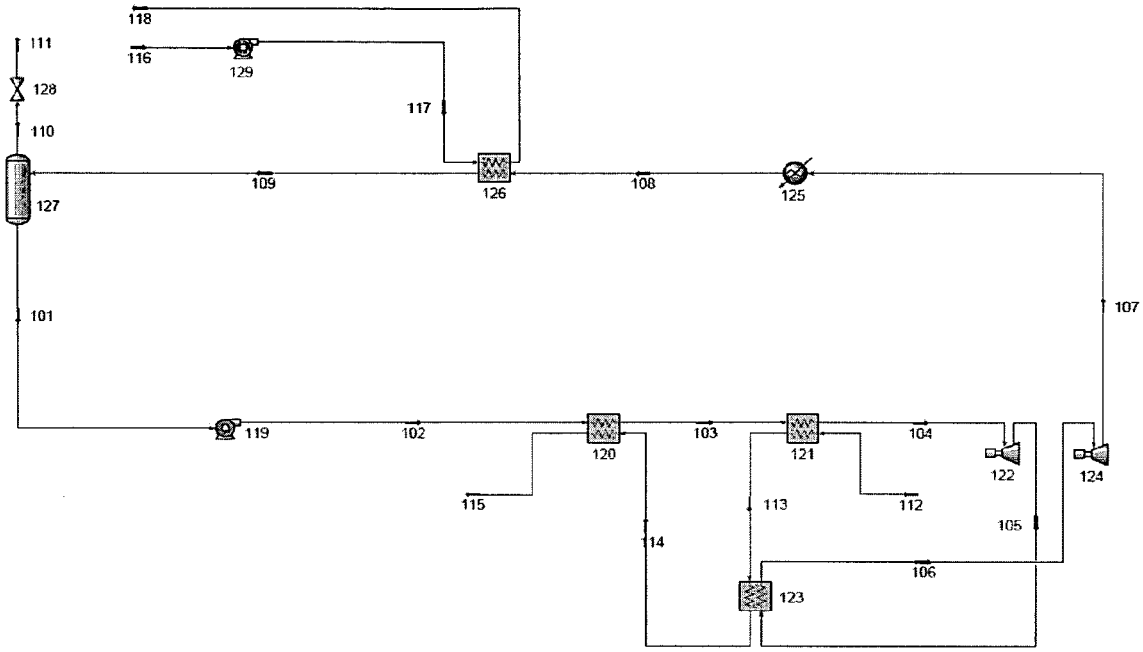
Figure 5 (Prior Art)
FIG. 5 is a schematic diagram of one illustrative embodiment of the prior art employed as an Organic Rankine Cycle with two turbines or expanders and one reheat.

In the illustrative embodiment depicted in FIG. 4, the working fluid enters the first heat recovery heat exchanger 37 and the economizer heat exchanger 27 as a cool, high pressure liquid and, after being recombined in the first flow mixer 28, leaves as a hot liquid 5. The working fluid 5 then enters the second heat recovery heat exchanger 29 and leaves as a superheated vapor 6. The high pressure, superheated vapor 6 is then expanded through a turbine 31 to produce mechanical power after passing through a separator 30 and split into a dry vapor 7 and a liquid 12. The vapor 8 exiting the turbine 31 is at low pressure and in the superheated state and it is passed through the economizer heat exchanger 27 and the second fluid mixer 33. After the second fluid mixer 33, this vapor is then introduced into the condenser heat exchanger 43. The condensed low pressure liquid 15 is fed to the suction of a pump 25 via a drum 35 and is pumped to the high pressure required for the first heat recovery heat exchanger 37, the economizer heat exchanger 27 and the liquid bypass valve 41.

As described above, the present invention may employ a single component working fluid that may be comprised of any of the previously mentioned or similar fluids. After a complete reading of the present application, those skilled in the art will recognize that the present invention is not limited to any particular type of working fluid or refrigerant. Thus, the present invention should not be considered as limited to any particular working fluid unless such limitations are clearly set forth in the appended claims.

In one specific embodiment of the present invention, the mechanical power available at the output shaft of the turbine may be utilized directly or through a gearbox to provide mechanical work to drive an electrical power generator to produce electrical power either as a constant voltage and constant frequency AC source or as a DC source which might be rectified to produce AC power at a constant voltage and constant frequency.

In another specific embodiment, the mechanical power available at the output shaft of the turbine may be utilized directly or through a gearbox to provide mechanical work to drive any combination of mechanical devices such as a compressor, a pump, a wheel, a propeller, a conveyer, a fan, a gear, or any other mechanical device(s) requiring or accepting mechanical power input. Moreover, the present invention is not restricted to stationary devices, as it may be utilized in or on an automobile, a ship, an aircraft, a spacecraft, a train, or other non-stationary vessel.

A specific byproduct of the method of the present invention is an effective and dramatic reduction in the emissions of both pollutants and greenhouse gases. This method may not require any fuel nor does it generate any pollutants or greenhouse gases or any other gases as byproducts. Any process to which this method may be applied, such as a gas turbine or a diesel engine, will generate significantly more power with no increase in fuel consumption or pollution. The effect of this method is a net reduction in the specific pollution generation rate on a mass per power produced basis.

The present invention is generally directed to various systems and methods for producing mechanical power from a heat source. In various illustrative examples, the devices employed in practicing the present invention may include heat recovery heat exchangers, turbines or expanders, an economizer heat exchanger, a desuperheater heat exchanger, a condenser heat exchanger, an accumulator, a separator, and a liquid circulating pump, etc. In one illustrative embodiment, the system comprises heat exchangers adapted to receive a fluid from a heat source and a working fluid, wherein, when the working fluid is passed through the first heat exchanger, the working fluid is converted to a vapor via heat transfer from the heat contained in the fluid from the heat source, at least one turbine adapted to receive the vapor, and an economizer heat exchanger adapted to receive exhaust vapor from the turbine and a portion of the working fluid, wherein a temperature of the working fluid is adapted to be increased via heat transfer with the exhaust vapor from the turbine prior to the introduction of the working fluid into the second heat exchangers. The system further comprises a condenser heat exchanger that is adapted to receive the exhaust vapor from the turbine after the exhaust vapor has passed through the economizer heat exchanger and a cooling fluid, wherein a temperature of the exhaust vapor is reduced via heat transfer with the cooling fluid, and a pump that is adapted to circulate the working fluid to the first and second heat exchanger and the economizer heat exchanger.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A system, comprising:

a flow divider adapted to receive a working fluid and divide said working fluid into at least first and second portions;

a first heat exchanger adapted to receive a hot heating stream from a heat source after said hot heating stream passes through a second heat exchanger and said first portion of a working fluid, wherein, when the first portion of said working fluid is passed through the first heat exchanger, the first portion of said working fluid is converted to a first hot liquid stream via heat transfer with said hot heating stream from said heat source;

an economizer heat exchanger adapted to receive a hot vapor discharged from at least one turbine and said second portion of said working fluid, wherein, when the second portion of said working fluid is passed through the economizer heat exchanger, the second portion of said working fluid is converted to a second hot liquid stream via heat transfer with said hot vapor discharged from said at least one turbine;

a first flow mixer adapted to receive at least said first hot liquid stream and said second hot liquid stream and discharge said at least first hot liquid stream and said second hot liquid stream as a combined hot liquid working fluid;

a second heat exchanger adapted to receive a hot heating stream from a heat source and said combined hot liquid working fluid, wherein, when the combined hot liquid working fluid is passed through the second heat exchanger, the combined hot liquid working fluid is converted to a hot vapor via heat transfer with said hot heating stream from said heat source;

at least one separator adapted to receive said hot vapor from said second heat exchanger and separate said hot vapor into its liquid and gaseous phases for the purpose of preventing liquid from entering said at least one turbine;

at least one liquid control valve to relieve said liquid from said at least one separator, wherein said at least one turbine is adapted to receive said hot vapor from said separator and produce rotational, mechanical power at a shaft that is adapted to transmit said power to at least one device adapted to receive said power;

a second flow mixer that is adapted to receive and combine said vapor discharged from said at least one turbine after said vapor passes through said economizer heat exchanger and a fluid from the discharge of said liquid control valve into a single stream to be condensed;

a condenser heat exchanger that is adapted to receive said single stream to be condensed and a cooling fluid, wherein the temperature of said single stream to be condensed is reduced via heat transfer with said cooling fluid;

a liquid accumulator that is adapted to receive said cooled working fluid, provide storage for said cooled working fluid, and provide a surge volume for said system; and, at least one pump that is adapted to circulate said cooled working fluid to said first heat exchanger and said economizer heat exchanger via said flow divider.

2. The system of claim 1 wherein said working fluid enters said second heat exchanger as a supercritical liquid and via heat transfer with the fluid from the heat source changes state from a supercritical liquid to a supercritical vapor.

3. The system of claim 1 wherein said cooling fluid for said condenser heat exchanger comprises at least one of a liquid and a gas.

4. The system of claim 1 wherein said cooling fluid for said condenser heat exchanger is a partially or fully vaporized liquid as it passes through said condenser heat exchanger.

5. The system of claim 1 wherein said condenser heat exchanger is adapted to condense the exhaust vapor from said at least one turbine or expander to a liquid at a temperature between approximately 0-250° F.

6. The system of claim 1, wherein said working fluid is R-123 or one of its derivatives and said fluid from said heat source has a temperature of between approximately 450-1500° F., the maximum temperature of the working fluid is between approximately 363-700° F., and wherein said pump is adapted to operate at a discharge pressure greater than approximately 550 psia.

7. The system of claim 1, wherein said working fluid is R-134A or one of its derivatives and said fluid from said heat source has a temperature of between approximately 275-1500° F., the maximum temperature of the working fluid is between approximately 214-650° F., and wherein said pump is adapted to operate at a discharge pressure greater than approximately 600 psia.

8. The system of claim 1, wherein said working fluid is methyl alcohol (methanol) or one of its derivatives and said fluid from said heat source has a temperature of between approximately 500-2500° F., the maximum temperature of the working fluid is between approximately 463-963° F., and wherein said pump is adapted to operate at a discharge pressure greater than approximately 1070 psia.

9. The system of claim 1, wherein said working fluid is bromine and said fluid from said heat source has a temperature of between approximately 500-2500° F., the maximum temperature of the working fluid is between approximately 592-1092° F., and wherein said pump is adapted to operate at a discharge pressure greater than approximately 1500 psia.

10. The system of claim 1, wherein said working fluid is carbon tetrachloride and said fluid from said heat source has a temperature of between approximately 600-2500° F., the maximum temperature of the working fluid is between approximately 542-1042° F., and wherein said pump is adapted to operate at a discharge pressure greater than approximately 1000 psia.

11. The system of claim 1, wherein said working fluid is ethyl alcohol or one of its derivatives and said fluid from said heat source has a temperature of between approximately 500-2500° F., the maximum temperature of the working fluid is between approximately 470-970° F., and wherein said pump is adapted to operate at a discharge pressure greater than approximately 920 psia.

12. The system of claim 1, wherein said working fluid is R-150A and said fluid from said heat source has a temperature of between approximately 500-2500° F., the maximum temperature of the working fluid is between approximately 482-982° F., and wherein said pump is adapted to operate at a discharge pressure greater than approximately 730 psia.

13. The system of claim 1, wherein said working fluid is thiophene and said fluid from said heat source has a temperature of between approximately 600-2500° F., the maximum temperature of the working fluid is between approximately 583-1083° F., and wherein said pump is adapted to operate at a discharge pressure greater than approximately 730 psia.

14. The system of claim 1, wherein said working fluid is a mixture of hydrocarbons containing ten or fewer carbon atoms per molecule, said fluid from said heat source has a temperature of between approximately 400-2500° F., the maximum temperature of the working fluid is between approximately 400-1000° F., and wherein said pump is adapted to operate at a discharge pressure greater than approximately 300 psia.

15. The system of claim 1, wherein said at least one turbine drives at least one electrical generator to produce electrical power.

16. The system of claim 1, wherein said at least one turbine drives at least one compressor.

17. The system of claim 1, wherein said at least one turbine drives said at least one pump.

18. The system of claim 1, wherein said at least one turbine drives at least one electrical generator to produce electrical power and drives said at least one pump.

19. A system, comprising:

a flow divider adapted to receive a working fluid and divide said working fluid into at least three portions;

a first heat exchanger adapted to receive a hot heating stream from a heat source after said hot heating stream passes through a second heat exchanger and a first portion of a working fluid, wherein, when the first portion of said working fluid is passed through the first heat exchanger, the first portion of said working fluid is converted to a first hot liquid stream via heat transfer with said heating stream from said heat source;

an economizer heat exchanger adapted to receive a hot vapor discharged from at least one turbine and a second portion of said working fluid, wherein, when the second portion of said working fluid is passed through the economizer heat exchanger, the second portion of said working fluid is converted to a second hot liquid stream via heat transfer from the heat contained in said hot vapor discharged from at least one turbine;

a bypass desuperheater liquid control valve to regulate the flow of a third portion of said working fluid to a second flow mixer or desuperheater;

a first flow mixer adapted to receive said first hot liquid stream and said second hot liquid stream and discharge said first and second hot liquid streams as a combined hot liquid working fluid stream;

said second heat exchanger being adapted to receive said hot heating stream from said heat source and said combined hot liquid working fluid, wherein, when the combined hot liquid working fluid is passed through the second heat exchanger, the combined hot liquid working fluid is converted to a vapor via heat transfer with said hot heating stream from said heat source;

at least one separator adapted to receive said hot vapor from said second heat exchanger and separate said hot vapor into its liquid and gaseous phases for the purpose of preventing liquid from entering said at least one turbine;

at least one liquid control valve to relieve said liquid from said at least one separator, wherein said at least one turbine is adapted to receive said hot vapor and produce rotational, mechanical power at a shaft that is adapted to transmit said power to at least one device adapted to receive said power;

a second flow mixer that is adapted to receive and combine said vapor discharged from said at least one turbine after said vapor passes through said economizer heat exchanger, a fluid from the discharge of said liquid control valve, and said third portion of the working fluid from said bypass desuperheater liquid control valve into a single stream to be condensed;

a condenser heat exchanger that is adapted to receive said single stream to be condensed and a cooling fluid, wherein the temperature of said single stream to be condensed is reduced via heat transfer with said cooling fluid;

a liquid accumulator that is adapted to receive said cooled working fluid, provide storage for said cooled working fluid, and provide a surge volume for said system; and, at least one pump that is adapted to circulate said cooled working fluid to said first heat exchanger, said economizer heat exchanger, and said second fluid mixer or desuperheater via said bypass desuperheater liquid control valve via said flow divider.

20. The system of claim 19, wherein said working fluid enters said second heat exchanger as a supercritical liquid and via heat transfer with the fluid from the heat source changes state from a supercritical liquid to a supercritical vapor.

21. The system of claim 19, wherein said cooling fluid for said condenser heat exchanger comprises at least one of a liquid and a gas.

22. The system of claim 19, wherein said cooling fluid for said condenser heat exchanger is a partially or fully vaporized liquid as it passes through said condenser heat exchanger.

23. The system of claim 19, wherein said condenser heat exchanger is adapted to condense the exhaust vapor from said at least one turbine or expander to a liquid at a temperature between approximately 0-250° F.

24. The system of claim 19, wherein said working fluid is R-123 or one of its derivatives and said fluid from said heat source has a temperature of between approximately 450-1500° F., the maximum temperature of the working fluid is between approximately 363-700° F., and wherein said pump is adapted to operate at a discharge pressure greater than approximately 550 psia.

25. The system of claim 19, wherein said working fluid is R-134A or one of its derivatives and said fluid from said heat source has a temperature of between approximately 275-1500° F., the maximum temperature of the working fluid is between approximately 214-650° F., and wherein said pump is adapted to operate at a discharge pressure greater than approximately 600 psia.

26. The system of claim 19, wherein said working fluid is methyl alcohol (methanol) or one of its derivatives and said fluid from said heat source has a temperature of between approximately 500-2500° F., the maximum temperature of the working fluid is between approximately 463-963° F., and wherein said pump is adapted to operate at a discharge pressure greater than approximately 1070 psia.

27. The system of claim 19, wherein said working fluid is bromine and said fluid from said heat source has a temperature of between approximately 500-2500° F., the maximum temperature of the working fluid is between approximately 592-1092° F., and wherein said pump is adapted to operate at a discharge pressure greater than approximately 1500 psia.

28. The system of claim 19, wherein said working fluid is carbon tetrachloride and said fluid from said heat source has a temperature of between approximately 600-2500° F., the maximum temperature of the working fluid is between approximately 542-1042° F., and wherein said pump is adapted to operate at a discharge pressure greater than approximately 1000 psia.

29. The system of claim 19, wherein said working fluid is ethyl alcohol or one of its derivatives and said fluid from said heat source has a temperature of between approximately 500-2500° F., the maximum temperature of the working fluid is between approximately 470-970° F., and wherein said pump is adapted to operate at a discharge pressure greater than approximately 920 psia.

30. The system of claim 19, wherein said working fluid is R-150A and said fluid from said heat source has a temperature of between approximately 500-2500° F., the maximum temperature of the working fluid is between approximately 482-982° F., and wherein said pump is adapted to operate at a discharge pressure greater than approximately 730 psia.

31. The system of claim 19, wherein said working fluid is thiophene and said fluid from said heat source has a temperature of between approximately 600-2500° F., the maximum temperature of the working fluid is between approximately 583-1083° F., and wherein said pump is adapted to operate at a discharge pressure greater than approximately 730 psia.

32. The system of claim 19, wherein said working fluid is a mixture of hydrocarbons containing ten or fewer carbon atoms per molecule, said fluid from said heat source has a temperature of between approximately 400-2500° F., the maximum temperature of the working fluid is between approximately 400-1000° F., and wherein said pump is adapted to operate at a discharge pressure greater than approximately 300 psia.

33. The system of claim 19, wherein said at least one turbine drives at least one electrical generator to produce electrical power.

34. The system of claim 19, wherein said at least one turbine drives at least one compressor.

35. The system of claim 19, wherein said at least one turbine drives said at least one pump.

36. The system of claim 19, wherein said at least one turbine drives at least one electrical generator to produce electrical power and drives said at least one pump.

* * * * *